United States Patent [19]

Rozas

[11] 4,224,111

[45] Sep. 23, 1980

[54] EXIT AIR DUCT FOR THE DISCHARGE OF GASES PRODUCED IN COKE-OVENS

[76] Inventor: Günther Rozas, Am Hasenbusch 7, Erkrath 1, Fed. Rep. of Germany

[21] Appl. No.: 939,350

[22] Filed: Sep. 5, 1978

[51] Int. Cl.[2] ..... C10B 27/06

[52] U.S. Cl. ..... 202/255; 98/115 VM; 202/263

[58] Field of Search ..... 202/254, 255, 263, 260, 202/261; 98/115 VM

[56] References Cited

U.S. PATENT DOCUMENTS

| | | | |
|---|---|---|---|
| 4,069,108 | 1/1978 | Riecker | 202/263 |
| 4,123,333 | 10/1978 | Schulte et al. | 202/263 X |

*Primary Examiner*—Arnold Turk

*Attorney, Agent, or Firm*—Dressler, Goldsmith, Shore, Sutker & Milnamow, Ltd.

[57] ABSTRACT

An exit air duct for the discharge of gases produced in coke-ovens, provided with a collection duct which on its top side has a slot extending parallel thereto. A box-like superstructure that extends parallel to the collection duct adjoins the wall thereof on either side of the slot and has an open top side and underside. The top side of the superstructure carries a guide for a flexible cover belt which serves to seal the top side and which can be lifted off locally to admit the gases. An upper grate is located in the superstructure on the top side thereof and consists of screen plates extending transversely to the superstructure. Additionally, an air duct is formed in the superstructure below the guide and the grate and extends parallel to the superstructure.

4 Claims, 4 Drawing Figures

EXIT AIR DUCT FOR THE DISCHARGE OF GASES PRODUCED IN COKE-OVENS

An exit air duct for the discharge of gases produced in coke-ovens is known to the state of the art. They normally extend along the doors of the chambers of a coke-oven and are connected to a displacement track for a collection device which in turn can be moved in front of any desired chamber in order to receive the hot gases which are charged with dust and which arise on pushing and/or quenching of the coke, and to pass them into the exit air duct. A flexible cover belt that seals the top side of the exit air duct is here lifted locally off the collection device and the gases are passed from above through the superstructure and the grate into the exit air duct which is connected to an extractor fan and a purifying installation.

Since, at a tolerable economic cost, only materials which themselves do not withstand the high temperatures of the gases flowing through the exit air duct can be used for a flexible cover belt which must adequately seal the exit air duct over almost its entire length, it was proposed for the known exit air duct to screen the cover belt from the collection duct by an upper grate formed from plates and additionally to provide an air duct between the grate and the collection duct, which air duct on the one hand creates a spacing to reduce the absorption of radiant heat and on the other hand makes it possible to introduce cooling air which is directed onto the cover belt and can cool the latter. When hot gases arise, these flow for the major part through the collection duct but they also reach the air duct and impinge there on the cover belt; this fraction of the hot gases can, however, be cooled by mixing with cooling air so that the heat loading, in view of the relatively short action time, is not sufficient to heat the cover belt to a temperature at which it is damaged, since in the intervals between actions the cover belt is cooled again to a lower temperature by the cooling air which is continuously introduced.

Accordingly, the known exit air duct has the following disadvantages: without the introduction of cooling air, the cover belt does not withstand the heat load; if, however, cooling air is taken from the surroundings, this cooling air contains a certain amount of dust in spite of all protective measures so that the introduction nozzles must be designed relatively large in order to avoid rapid clogging and hence the necessity of dismantling and cleaning. Moreover, since only relatively low blowing-in velocities can be achieved because of the large nozzle orifices which are thus required and because of the relatively slight reduced pressure prevailing in the exit air duct, but since it is on the other hand necessary to cool the entire surface of the cover belt, the result is a requirement for the provision of a relatively large number of nozzles. In addition to the considerable constructural expense thus required, this also entails the disadvantage that the extractor fan is continuously loaded with considerable quantities of cooling air and must therefore be designed--and under certain circumstances this also applies to the purifying installation--for a higher throughput than would be necessary without the supply of cooling air. Finally, the impingement of hot gases on the nozzle orifices also leads to a local fall in the pressure gradient required for drawing cooling air in so that only a small amount of cooling air can enter precisely at the nozzles which are close to those zones of the cover belt which are subject to an especially high instantaneous heat load.

The provision of forced ventilation with its own fan would admittedly assist, but it would entail additional high investment cost and operating cost.

Starting from this state of the art, it is the object of the invention to improve the exit air duct mentioned at the outset in such a way that continuous operation at a more favorable cost is possible without damaging the cover belt.

According to the invention, this object is achieved when a second grate with plates extending transversely to the superstructure is provided on the underside thereof and when the air duct is sub-divided into air chambers by means of transverse partitions. The air duct is thus separated by the lower grate from the collection duct, whilst relatively small air spaces which are closed upwards by the cover belt, are formed by the upper grate which is located on the top side of the superstructure and thus adjoins the cover belt. If hot gases are passed into the exit air duct, the formation of a steady secondary flow in the air duct is prevented by the transverse partitions so that prolonged flowing-past of hot gases in the air duct is effectively stopped. Since, furthermore, the hot gases are introduced discontinuously into the collection duct which, however, is always under a reduced pressure, external air continuously penetrates at the door extraction and through leakage points into the air chambers during the time intervals between two successive introductions of gas and forms therein a relatively cool air cushion which - together with the heat removal to the outside via duct walls - cools the surface of the cover belt. When gas is now introduced, this air cushion effectively prevents the penetration of relatively large quantities of gas and is merely set into a relatively slow motion by the gas flowing past the lower grate, so that the heat transfer between the first and the second grate is severely slowed down. Likewise, several small air cushions which in turn are set into a circulating flow by the motion of the air enclosed in the air chamber, are enclosed in the lower grate in the zone adjoining the cover belt. As a result of this, the heat transfer to the surface of the cover belt is once more slowed down so that, in the overall effect, a substantially shallower heat gradient is obtained in place of the steep heat gradient arising at the lower grate on the side of the collection duct; peak temperatures on the surface of the cover belt are thus avoided and, in addition, the rigorous cooling required in the known exit air duct is therefore not necessary, but instead, the gradual cooling by the cooler gases during the intervals between introductions is sufficient, as was described above. A particular advantage of the invention is that damaging heat peaks, as in the known exit air duct, can no longer occur on the cover belt at those points where the required cooling fails because of clogging or wrong arrangement of a cooling air nozzle. Since the cover belt is subjected to high stresses when the gas introduction device is displaced, local overheating of this type would lead very rapidly to tearing and hence premature wear of the cover belt so that the invention here results in an especially important saving. Furthermore, this dispenses with the ongoing expense on maintenance for checking and cleaning the cooling air nozzles, and the extractor fan and the purifying installation are not continuously loaded with cooling air in addition.

It can be advantageous to leave a small free interspace between the top side of the upper grate and the lower surface of the cover belt or to design the top side of the upper grate in such a way that only relatively few rest points for the cover belt are provided in order to prevent the generation of temperature peaks in the cover belt by heat conduction in the plates of the upper grate. According to an embodiment of the invention, however, it is a particular advantage that the plates representing the grate form, with the cover belt, a seal on their top side in order to prevent the possible formation of a through-duct which extends along the surface of the cover belt in the longitudinal direction of the exit air duct and through which hot gases could penetrate under certain circumstances. Heat transfer, which may be feared, through the plates of the upper grate can here be avoided when these plates have a defined minimum height and are designed with relatively thin walls so that the relatively cool air cushions enclosed by the plates also sufficiently cool the plates in the course of their induced circulating motion so that local overheating of the cover belt is reliably prevented.

Nevertheless, in order to prevent effectively a flow of hot gases through the air chamber, if these arise in large amounts, as is conceivable say in the vicinity of the introduction point, the transverse partitions are, according to a further embodiment, mounted on the underside of plates of the second grate, and this makes it impossible for the air cushions which may be enclosed in the interspaces of the upper grate to come into direct contact with hot gases.

It is a fundamental advantage to arrange the screen plates of the lower grate at an inclination, as is already the case in the known exit air duct, the gas stream in the collection duct impinging at an acute angle onto the screen plates. Because of their inclination, the screen plates thus form a certain flow guide not only during the introduction of the gases but also when the introduced gases flow past upwards in the duct, and this effectively makes it impossible for gases flowing past to reach the air chambers without hindrance and to generate there a back-pressure which impairs their effect. It is here not necessary to give the screen plates a curved shape, but instead, the inexpensive plane design is as a rule adequate. According to an embodiment of the invention, the plates of the upper grate—preferably of plane design—are arranged either vertically or in an inclination in the same direction as the screen plates of the lower grate, the angle formed between the vertical (the cross-sectional plane of the exit air duct) and the plates or screen plates being smaller in the case of the plates than in the case of the screen plates, since air from the air cushions flowing in the air chambers is to be prevented from penetrating in a significant amount into the interspaces of the upper grate and from displacing the air cushion present therein. Rather, the inclination of the plates of the upper grate mainly serves to shape the gas stream introduced from above in order to prevent the formation of a flow in the upward direction of the duct at the point of introduction, which flow can only be extracted with long delay, is hence brought to a standstill and can thus locally overheat the cover belt by a convection effect.

In order to prevent the heat transfer from hot zones of the exit air duct to the cover belt, it is a fundamental advantage when the transverse partition is not in solid contact with screen plates of the lower grate. According to an embodiment, it is also an advantage to form the transverse partition from a material having a low heat conductivity, such as say asbestos-reinforced wire mesh. According to an alternative embodiment of the invention, however, it is also an advantage when the transverse partitions are one another but do not touch one another and which form narrow curved ducts between them, which represent such a high flow resistance that the transverse partitions virtually have the effect of a closed surface for gases flowing against them. It is here a fundamental advantage when the angled profiles are arranged horizontally; this will prevent gases, which leak through between the angled profiles, from initiating or even reinforcing a circulating motion, which in itself is undesirable, of the air cushion enclosed there in the adjacent air chamber. For this reason, it can sometimes be advantageous to arrange the angled profiles in such a way that the emerging leakage air has a direction opposite to the circulating motion of the air cushion in the adjacent air chamber.

The following specifications for the dimensions of the exit air duct according to the invention have been found to be particularly advantageous: the lower grate should preferably have the same height as or a greater height than the upper grate, the "height" being the vertical projection of the grate onto the cross-sectional plane of the collection duct, that is to say it is measured perpendicular to the axis of the collection duct; the height of the air chambers enclosed between the grates should have a height which is at least equal to the total height of the two grates taken together. In detail, the following specifications have been found to be particularly advantageous: the upper grate preferably has a height of 60 to 100% of the height of the lower grate, and the height of the air chambers enclosed between the grates advantageously amounts to between 100 and 170% of the total height of the two grates. The spacing of the two transverse partitions, measured in the direction of the axis of the collection duct, should in an air chamber advantageously amount to two to three-and-a-half times their height. These specifications ensure that, within the air chamber, a slow flow is generated which in the end results in a delay and reduction of the heat transfer. It is also essential here that, on the one hand, the air chamber is of such small dimensions that the blowing-in of hot gases is effectively prevented, but that it has on the other hand a sufficiently large volume to receive such a quantity of air that the quantity of heat absorbed at the lower grate is largely used for heating up this amount of air but not for harmful heating up of the cover belt.

Since the circulation velocity of the air enclosed in the air chamber is lower than the flow velocity of the gases flowing in the collection duct, it is fundamentally advantageous therefore when the longitudinal spacing of the plates of the upper grate is in all cases of the same magnitude, but preferably smaller than the longitudinal spacing of the screen plates of the lower grate; it should be stressed here that for reasons of heat conduction in the solid and for reasons of costs and weight, the number of plates and screen plates should be kept as small as possible; it has been found to be particularly advantageous when the lower grate has between 5 and 9 plates in each air chamber so that the upper grate correspondingly has the same number or a greater number of plates, preferably about twice the number.

In a particularly weight-saving design, the plates and/or screen plates would be welded individually into the walls of the superstructure since the fouling which may occur leaves the functioning of the plates substantially unimpaired. Since, however, the inclination, number and design of the plates can differ depending on the point of the exit air duct where they are to be fitted, and since, depending on the sizing and the operational characteristics of a particular installation, trials and alterations resulting from these may be necessary, a particularly cost-saving embodiment of the invention provides that at least the upper grate is designed as a removable insertion grate and that rest points for this are arranged in the superstructure. It is thus possible to insert individual sections of an insertion grate into the otherwise completely assembled exit air duct and, if necessary, to exchange them, without major interruptions in operation being necessary for this reason.

According to a further embodiment of the invention, a guide surface is provided on the underside of the lower and/or upper grate on either side, which guide surface extends parallel thereto and preferably can also be designed as a rest surface for insertion grates. This guide surface serves to form the horizontal flow and prevents or reduces the penetration of the hot gases into the air chamber or the penetration of the air from the air chamber into the interspaces of the upper grate.

The subject of the invention is explained in yet more detail, by way of example, by reference to the attached diagrammatic drawing in which.

Figure 1:
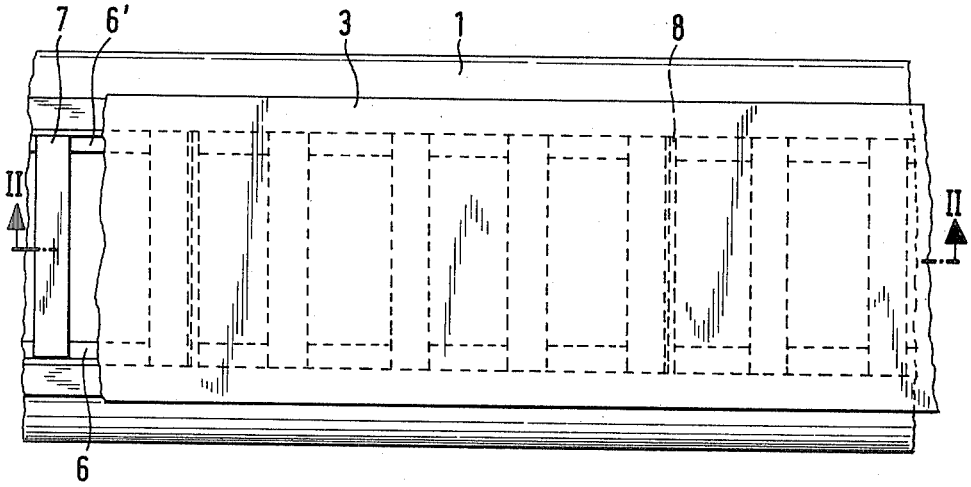
FIG. 1 shows the plan view of an exit air duct according to the invention.

The drawing shows in each case a section of an exit air duct which can be produced as a complete component or in individual sections, can be transported to the point of use and can be built in there.

The exit air duct comprises a lower collection duct 1 which has a circular cross-section and in the top side of which a slot is recessed which extends in the longitudinal direction of the duct; two mutually parallel side walls 2, 2' are welded in such a way to the edges of this slot that they are in a mutually symmetrical arrangement with respect to the center point of the duct 1. The two side walls 2, 2' form the side walls of a superstructure and their free top sides widen outwards in the manner of a flange, where they form a seat for the flexible cover belt 3.

An angled profile 4, 4' which extends parallel to the longitudinal axis of the collection duct 1 and on which a lower bar grate 5 is placed, is welded on each side of the slot to the attachment surface of the collection duct 1 and the side walls 2, 2'. Above this, on each of the two side walls of the superstructure, a further angled profile 6, 6' is welded on, which provides a seat which has just such a distance from the underside of the cover belt 3 that an upper grate 7 can be inserted. As can be seen from FIG. 3, the upper grate 7 can be removed without difficulty after the cover belt has been lifted off and, after one side has been tilted upwards, the first grate 5 can subsequently also be removed.

Figure 2:
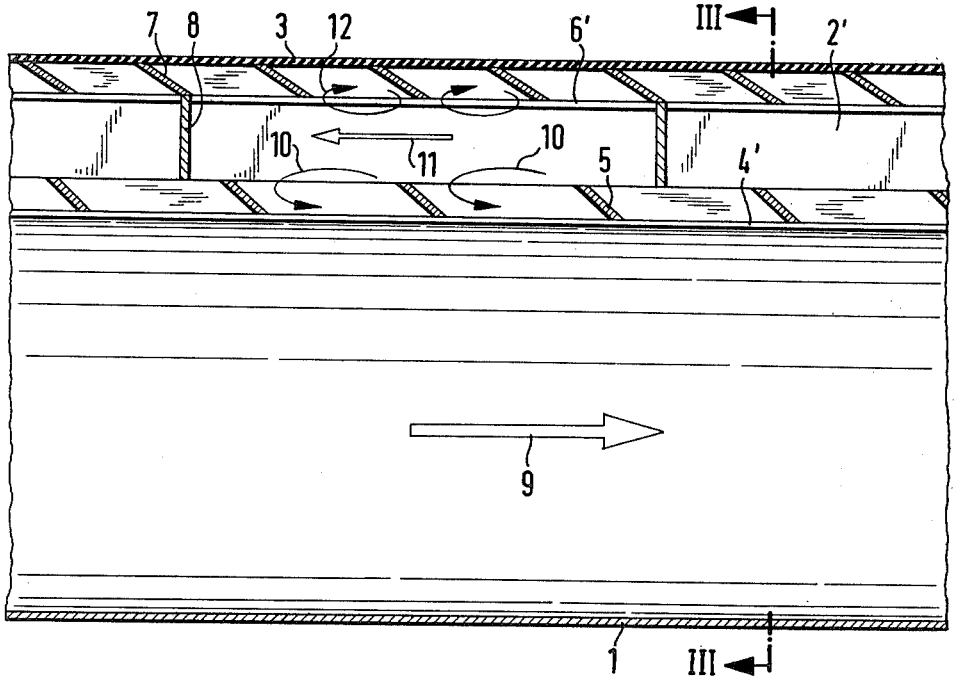
FIG. 2 shows a cut along line II—II in FIGS. 1 and 3.

As can be seen from FIG. 2, the air duct enclosed between the lower grate 5 and the upper grate 7 is subdivided into air chambers by transverse partitions 8.

As can be seen from FIG. 2, the transverse partitions 8 in the illustrative embodiment shown there are made from solid metal sheets, and the plates of the lower grate and also the plates of the upper grate are inclined relative to the direction 9 of flow in the collection duct 1.

Figure 4:
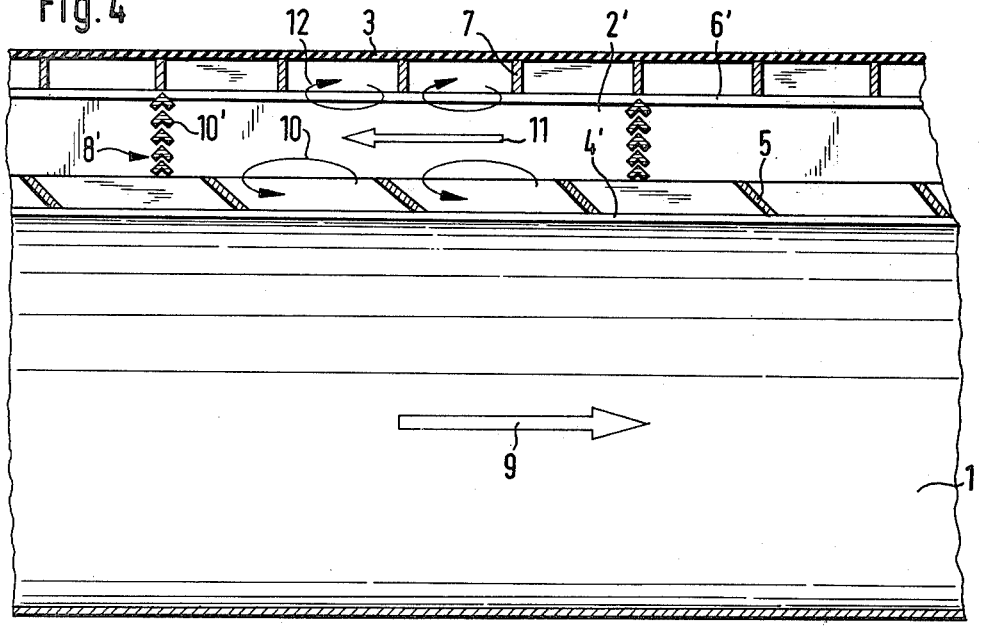
FIG. 4 shows a further embodiment of an exit air duct in a cut representation according to FIG. 2.

In another illustrative embodiment shown in FIG. 4, transverse partitions 8' are formed by bars 10' of angled profiles, which are perpendicular to the projection plane and are arranged at a small spacing one above the other. These bars of profiles are arranged in such a way that their pairs of arms point obliquely downwards; as stated further above, however, they can advantageously also be mounted in the converse way so that the two arms of the angled profiles 10 point upwards. In the second illustrative embodiment according to FIG. 4, the plates of the upper grate 7 are also perpendicular to the direction 9 of flow in the collection duct 1.

The mode of operation of the exit air duct is as follows: a relatively slow circulating flow, the direction of which is indicated by arrows 10, is induced in the interspaces of the lower grate 5 by the flow of the hot gases in the collection duct 1 in the direction 9. The circulating flows excite a further relatively slow flow, the direction of which is indicated by the arrow 11, in the air chamber located between the two grates 5, 7. This flow in turn excites further circulating flows, the direction of which is indicated by arrows 12, in the interspaces of the upper grate 7. The directions 9 and 11 and, respectively, the directions 10 and 12 are counter-current or contrary. Of course, the drawing shows a non-steady state which is excited by the flow front of hot gases and lasts approximately as long as hot gases flow in the direction 9. It is essential here that the spacing between the transverse partitions 8, 8' is so large that a non-steady straight-line flow 11 forms, but is on the other hand sufficiently short so that hot gases are not diverted into the air chamber and flow along there in the direction 9.

Figure 3:
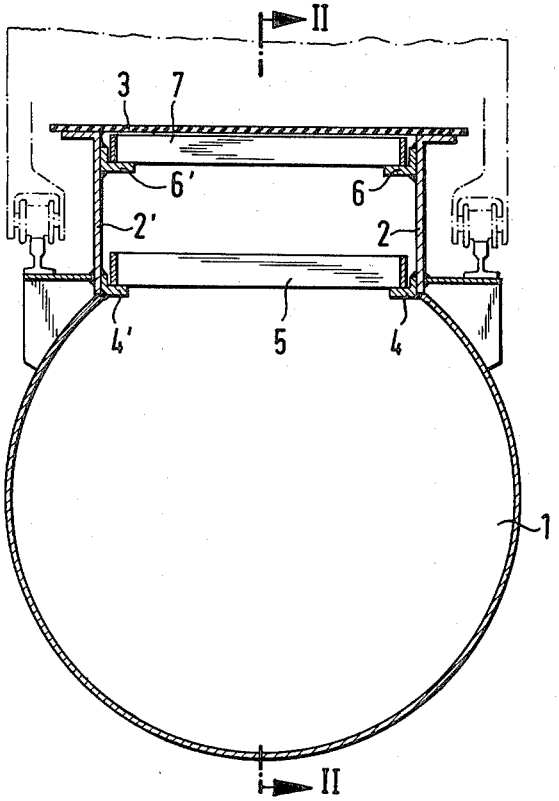
FIG. 3 shows a cut along line III—III in FIG. 2.

For a further clarification of the arrangement of the exit air duct according to the illustrative embodiments, FIG. 3 indicates in broken lines the lower part of a cover truck which can be driven on rails laid parallel to the exit air duct and on either side of the superstructure and which carries a device for locally lifting off the cover belt 3 and for introducing the hot gases.

To lower the temperature of the hot gases entering, it is also advantageous to provide, on the device for introducing the hot gases, an additional device for extraction at the doors of the particular coke-oven chamber over which the device for extracting the hot gases is located at that instant. The cooler gas or the cooler air from the extraction at the door can be accelerated by means of injector jets and, at the same time, its pressure can be reduced and it can be cooled down; this makes it possible already to premix the hot gases with cooler gases so that - in conjunction with the exit air duct according to the invention - damage to the cover belt is reliably prevented.

In the following text, a design example is described; the following dimensions of the exit air duct are here taken as the starting point:

Diameter of the collection duct: 1.83 m
Wall thickness of the collection duct: 6 mm
Length of the collection duct: 100 m
Material of the cover belt: rubber
Maximum temperature permissible for the rubber: 150° C.
Height of the lower grate (illustrative embodiment according to FIG. 2): 30 cm
Height of the air chamber (illustrative embodiment according to FIG. 2): 60 cm Height of the upper grate (illustrative embodiment according to FIG. 2): 30 cm Spacing of the plates in the two grates (illustrative embodiment according to FIG. 2): 80–100 cm The following dimensions of the superstructure according to FIG. 4 correspond to the dimensions of the superstructure according to FIG. 2:

Height of the lower grate: 30–50 cm

Height of the air chamber: 60–100 cm

Height of the upper grate: 30 cm

Transverse partitions consisting of No. 15 to No. 20 angled irons.

Hot gas is introduced at a temperature of 400° C. and additionally cooler gas (approximately half the quantity of hot gas) is introduced at a temperature of 100° C. The hot gas period lasts 1 minute in each case, whilst the blast period for the subsequent cooling lasts 10.8 minutes. After hot and cold gas have mixed, the gas entry temperature is 295° C. and falls to 238° C. in the course of 100 m (that is to say the length of the exit air duct).

As a result of the design of the exit air duct in accordance with the invention, the rubber temperature on the cover belt nowhere exceeds a temperature of 134° C.

It is intended to cover by the appended claims all such modifications as fall within the true spirit and scope of the invention.

What is claimed is:

1. Duct means for the discharge of gases produced in coke-ovens comprising a collection duct defining a longitudinally extending slot in its upper wall; a box-like superstructure having generally opposed side walls and both an open top and an open bottom, the superstructure extending along the length of and parallel to the collection duct and the bottoms of the side walls of the superstructure being connected thereto along opposite sides of the slot, a flexible cover belt on said superstructure, the tops of the side walls of the superstructure supporting the flexible cover belt, the top of the superstructure being sealed off through engagement of said side walls with said flexible cover belt, which cover belt can be locally lifted off to allow admission of said gases, upper grate means located in the top portion of the superstructure and consisting of spaced-apart grate plates extending transversely to the collection duct and inclined away from said belt in the direction of the gas flow in said collection duct, lower grate means located in the bottom portion of the superstructure and consisting of spaced-apart screen plates extending transversely to the collection duct and inclined away from said belt in the direction of the gas flow, said upper and lower grate means defining an air duct therebetween and functioning to generate transient counter-current circulating flows of said gases with a portion of the circulating flow generated by said screen plates creating a relatively low speed flow between said upper and lower grate means in a direction opposite to said collection duct gas flow, and transverse partitions extending across said superstructure subdividing said air duct into air chambers, the volume of each air chamber being such that the flow of hot gases into said air duct from the collection duct is greatly reduced and such that the portion of the heat absorbed at the lower grate is transferred to said gases and air flowing into said air duct without excessively heating up said cover belt.

2. Duct means as set forth in claim 1 in which the upper grate means and flexible cover belt are in sealing relationship.

3. Duct means as set forth in claim 1 in which the transverse partitions are formed by spaced angled metal profiles.

4. Duct means as set forth in claim 1 in which the spacing between transverse partitions is on the order of two to three-and-a-half times their height.

* * * * *

UNITED STATES PATENT AND TRADEMARK OFFICE

CERTIFICATE OF CORRECTION

PATENT NO. : 4,224,111

DATED : September 23, 1980

INVENTOR(S) : Gunther Rozas

It is certified that error appears in the above-identified patent and that said Letters Patent are hereby corrected as shown below:

Column 4, line 5, after "are" insert --formed by angled metal profiles which are stacked close to--.

Signed and Sealed this

*Ninth* Day of *December 1980*

[SEAL]

*Attest:*

SIDNEY A. DIAMOND

*Attesting Officer*

*Commissioner of Patents and Trademarks*